US011288930B1

(12) United States Patent
Lim et al.

(10) Patent No.: US 11,288,930 B1
(45) Date of Patent: Mar. 29, 2022

(54) GAME METHOD USING TICKET OUTPUT GAME MACHINE

(71) Applicant: KOMUSE Co., Ltd., Paju-si (KR)

(72) Inventors: Gyo In Lim, Goyang-si (KR); Nam Ho Kang, Gimpo-si (KR); Seong Ho Park, Goyang-si (KR); Byeong Soo Seo, Goyang-si (KR); Ryeol Baek, Goyang-si (KR)

(73) Assignee: KOMUSE CO., LTD., Paju-si (KR)

( * ) Notice: Subject to any disclaimer, the term of this patent is extended or adjusted under 35 U.S.C. 154(b) by 0 days.

(21) Appl. No.: 17/317,604

(22) Filed: May 11, 2021

(51) Int. Cl.

| | |
|---|---|
| ***G07F 17/00*** | (2006.01) |
| ***G07F 19/00*** | (2006.01) |
| ***G07F 17/32*** | (2006.01) |
| ***A63F 9/02*** | (2006.01) |

(52) U.S. Cl.
CPC ..... *G07F 17/3297* (2013.01); *A63F 9/0247* (2013.01); *G07F 17/3248* (2013.01)

(58) Field of Classification Search
CPC ..... G07F 17/3295; G07F 17/3297; A63F 9/0247; A63F 7/00; A63F 7/0058; A63F 2007/0064; A63F 2007/007
See application file for complete search history.

(56) References Cited

U.S. PATENT DOCUMENTS 3,572,703 A * 3/1971 Greene ..... A63F 7/0058 273/448
4,036,497 A * 7/1977 Garto ..... A63F 7/02 273/357
4,095,794 A * 6/1978 Garto ..... G07F 17/3213 273/142 A
4,120,497 A * 10/1978 Goldfarb ..... A63F 9/0247 273/351
5,788,230 A * 8/1998 Krise ..... A63F 7/022 273/120 A
5,855,374 A * 1/1999 Shoemaker, Jr. ..... A63F 9/30 273/447
7,192,342 B2 * 3/2007 Shoemaker, Jr. ..... A63F 9/30 273/138.3
7,637,507 B2 * 12/2009 Peck ..... A63F 9/30 273/448
7,857,318 B1 * 12/2010 Shoemaker, Jr. ..... A63F 9/30 273/448

(Continued)

FOREIGN PATENT DOCUMENTS

KR 20-0240883 Y1 10/2001

*Primary Examiner* — Milap Shah
(74) *Attorney, Agent, or Firm* — Rabin & Berdo, P.C.

(57) ABSTRACT

The present invention relates to a game method using a ticket output game machine in which, at a moment that a ball throwing portion horizontally moving along a rail portion arrives at a determined position on a game plate, a drop button is manipulated to allow a ball gripped by the ball throwing portion to be dropped onto the game plate so as to insert the ball into a bonus hole device or ball insertion holes corresponding to LEDs emitting light having different colors. An LED color signal of the ball insertion hole into which the ball is inserted or a signal of the bonus hole device or a ball discharge hole is analyzed and a score corresponding thereto is output to a general score plate or a bonus score plate. A number of tickets corresponding to the score is output through a ticket output portion and obtained.

7 Claims, 9 Drawing Sheets

(56) References Cited

U.S. PATENT DOCUMENTS

| | | | | |
|---|---|---|---|---|
| 8,267,405 | B1 * | 9/2012 | Tsai | G07F 17/3297 273/460 |
| 8,899,585 | B2 * | 12/2014 | Tokue | G07F 17/3216 273/138.3 |
| 9,526,978 | B1 * | 12/2016 | Shoemaker, Jr. | G07F 17/3246 |
| 2007/0057451 | A1 * | 3/2007 | Halliburton | G07F 17/3297 273/138.1 |
| 2008/0280661 | A1 * | 11/2008 | Shoemaker, Jr. | A63F 9/0247 463/7 |
| 2013/0214491 | A1 * | 8/2013 | Shoemaker, Jr. | F41J 5/24 273/348 |
| 2015/0018058 | A1 * | 1/2015 | Sato | A63F 7/0058 463/7 |

* cited by examiner

GAME METHOD USING TICKET OUTPUT GAME MACHINE

BACKGROUND

1. Field of the Invention

The present invention relates to a game method using a game machine, and more particularly, to a game method using a ticket output game machine in which a ball of a ball throwing portion moving along a rail portion to obtain a score is to be dropped and inserted into a ball insertion hole or a bonus hole device corresponding to a light emitting diode (LED) emitting light on a game plate so as to obtain a ticket number corresponding to the score.

2. Discussion of Related Art

Generally, through a game vending machine, a prize or tickets which are designated according to an outcome of a game is obtained so that a sense of accomplishment is obtained even more in an aspect of enjoying the game.

Here, in the game vending machine, an outcome of a game is determined according to a manipulation ability of a user so that the user who is enjoying the game feels a sense of accomplishment as well as obtaining a prize or tickets.

Patent Document 1 relates to a conventional falling object goal game machine. Referring thereto, the machine includes a case including a transparent window, a manipulating handle having one end exposed in front of the case and the other end located inside the case and horizontally moved forward, backward, leftward, or rightward, a goal rim installed at an end of the manipulating handle, located in the case, and horizontally moved by the manipulating handle so as to pass a ball and sense whether the ball passes, and a display portion installed on an inner wall surface of the case and configured to display the number of balls passing through the goal rim or a score.

Here, a function input button configured to rotate a prize holder connected a motor installed on the inner wall surface of the case by rotationally driving the motor is further formed on a front surface of the case.

Here, the function input button may selectively control rotational driving of the motor and the prize holder.

That is, when a coin is inserted into the case, a plurality of balls provided in a ball collection hopper fly in the air as an air blower is turned on and operates so that the balls are located at an upper part of the case.

Subsequently, when the air blower is turned off and stops, the plurality of balls flying in the air are dropped downward toward the ball collection hopper. Here, the goal rim is horizontally moved leftward, rightward, forward, or backward while the manipulating handle is gripped so as to allow the ball dropped to the goal rim to pass therethrough.

Then, a score and the number of balls passing through the goal rim are displayed on the display portion to be proportional to the number of balls passing therethrough. Subsequently, when the ball is dropped to the ball collection hopper, the air blower is turned on/off as described above so as to allow the ball to be dropped from the air.

Also, when a determined score is obtained by allowing the ball to pass through the goal rim while flying in the air and being dropped, a prize corresponding to the score is selected by the function input button to obtain the prize held by the prize holder.

However, in Patent Document 1, physical strength is exhausted by repetitively performing an operation of passing the ball through the goal rim while horizontally moving the goal rim forward, backward, leftward, or rightward with the manipulating handle being gripped. Due to the exhaustion of physical strength, the old and the infirm or children have difficulty in playing a game. Also, when the operation of passing the ball through the goal rim is repetitively performed, the game becomes boring. Since the game is a simple game of shooting the ball upward and passing the dropped ball, it is impossible to set a level of difficulty of the game. Particularly, as a person becomes skilled in the game operation of passing the ball through the goal rim, the level of difficulty of the game is rapidly degraded, and thus fun and interest are reduced and reliability of the product is degraded.

RELATED ART DOCUMENT

Patent Document

Patent Document 1: KR20-0240883 Y1

SUMMARY OF THE INVENTION

The present invention is directed to providing a game method using a ticket output game machine in which, at a moment that a ball throwing portion horizontally moving along a rail portion arrives at a determined position on a game plate, a drop button is manipulated to allow a ball gripped by the ball throwing portion to be dropped onto the game plate so as to insert the ball into a bonus hole device or ball insertion holes corresponding to light emitting diodes (LEDs) emitting light having different colors. An LED color signal of the ball insertion hole into which the ball is inserted or a signal of the bonus hole device or a ball discharge hole is analyzed and a score corresponding thereto is output to a general score plate or a bonus score plate. An amount of tickets corresponding to the score is output through a ticket output portion and obtained.

According to an aspect of the present invention, there is provided a game method using a ticket output game machine. The method includes a first process of inserting a coin into a coin slot formed in a front surface of a body to allow a ball to be inserted into a ball throwing portion and horizontally moving the ball throwing portion along a rail portion installed on an inner top end of the body while gripping the ball, a second process of allowing a plurality of light emitting diodes (LEDs) installed on a game plate installed right below the rail portion and including a plurality of ball insertion holes on a top surface thereof to correspond to the ball insertion holes to emit light having different colors, a third process of sensing the ball throwing portion moving along the rail portion using a front sensor and moving the ball throwing portion backward when the ball throwing portion reaches a front end of the rail portion and sensing the ball throwing portion using a rear sensor and moving the ball throwing portion forward when the ball throwing portion reaches a rear end of the rail portion, a fourth process of pushing a drop button formed on the front surface of the body to allow the ball gripped by the ball throwing portion to be dropped onto the game plate, a fifth process of analyzing a color signal of the LED corresponding to the ball insertion hole into which the ball dropped in the fourth process is inserted, a signal of the bonus hole device installed in the game plate, or a signal of a ball discharge hole formed in a bottom end of the game plate and displaying a score on a general score plate formed on one side of a top surface of the game plate or a bonus score plate formed on a top end of the front surface of the body, and a sixth process of calculating a number of tickets corresponding to the score displayed in the fifth process and outputting the tickets through a ticket output portion formed on the front surface of the body.

In the first process, the ball throwing portion may be moved along the rail portion to be located at a ball supply hole formed in an inner rear surface of the body, receive the ball discharged through the ball supply hole in a housing of the ball throwing portion and stand by, and when the coin is inserted into the coin slot, control driving wheels formed on both sides of a top end of the housing to move along a top surface of the rail portion.

In the fourth process, the ball throwing portion may receive a signal of the drop button and release a support bar horizontally moved in the housing and supporting the ball while the ball throwing portion is continuously moved along the rail portion by driving wheels so as to control the ball to be dropped onto the game plate.

In the fourth process, the ball throwing portion may release a support bar horizontally moved in the housing and supporting the ball by receiving a signal of the drop button and continuously moved along the rail portion by driving wheels so as to control the ball to be dropped onto the game plate.

In the fifth process, a plurality of such ball insertion holes may be formed on a periphery of an edge of the bonus hole device and include first LEDs emitting light having different fixed colors and fixed score insertion holes corresponding to the first LEDs to analyze color of the first LED corresponding to the fixed score insertion hole into which the ball is inserted and to display a score on the general score plate. Otherwise, a plurality of such ball insertion holes may be formed on a periphery of an edge of the bonus hole device and include second LEDs having a plurality of colors sequentially changed corresponding to a color of the plurality of first LEDs and random score insertion holes corresponding to the second LEDs to analyze color of the second LED of the random score insertion hole into which the ball is inserted and to display a score on the general score plate. Otherwise, the bonus hole device may be formed in a central part of the game plate and allow the ball to be inserted thereinto so as to display a score on the bonus score plate.

In the sixth process, a sum of numbers of output tickets may be obtained when a number of times of outputting tickets through the ticket output portion exceeds a determined number of times, and an angle of the bonus hole device may be adjusted when the number of tickets exceeds a determined output number.

In the sixth process, the angle of the bonus hole device may be adjusted by rotating a connection rod rotatably installed at a bottom end of the bonus hole device and a connection shaft of a rotational rod rotatably installed on the connection rod at the same time, and a tilted angle of the bonus hole device may be adjusted by allowing an end of the rotational rod rotated by the motor to be stopped at any one of a top end sensor, an intermediate end sensor, and a bottom end sensor which are installed below the bonus hole device.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, an embodiment of the present invention will be described in detail with reference to the attached drawings.

Figure 1:
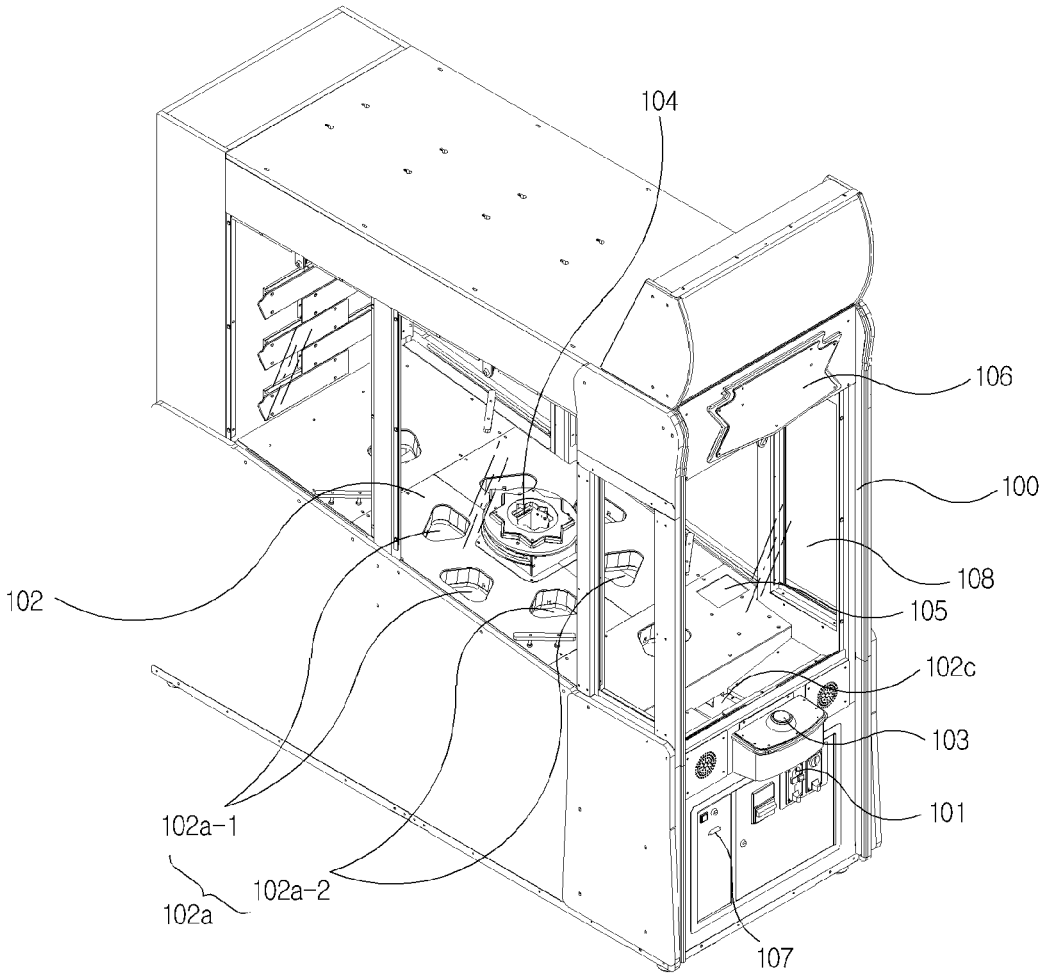
FIG. 1 is a perspective view of a ticket output game machine according to the present invention.
Figure 2:
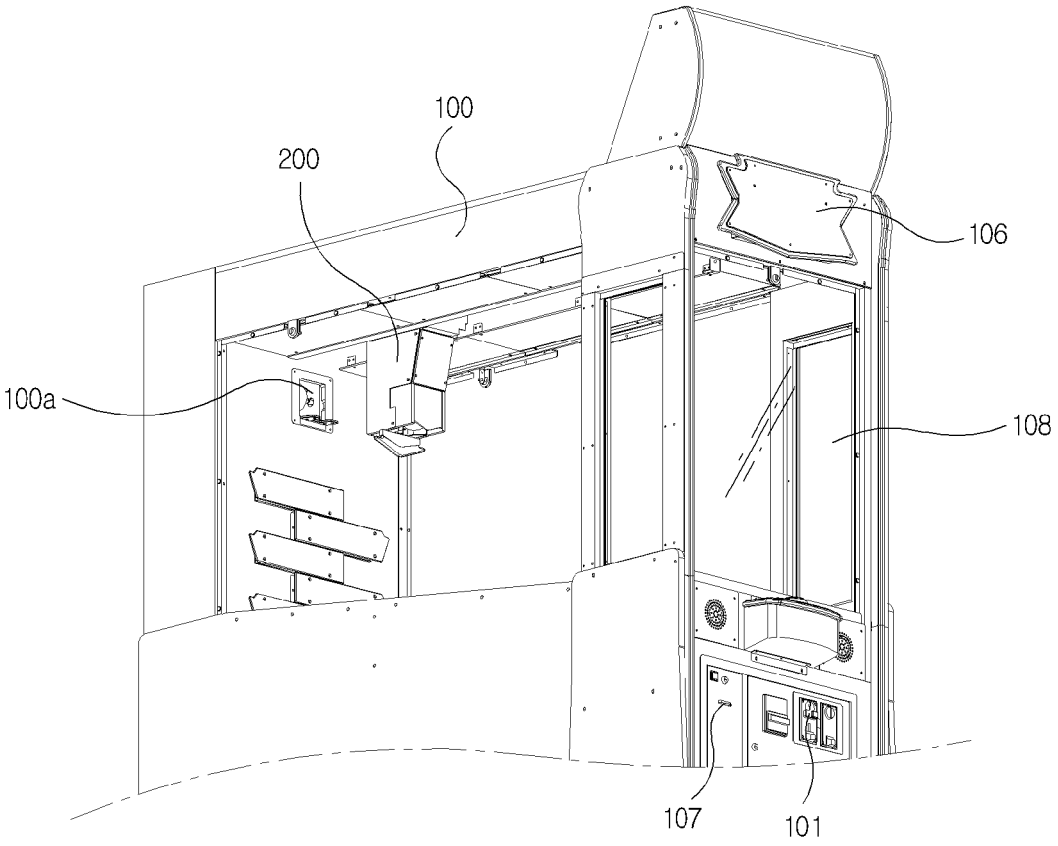
FIG. 2 is a partial perspective view of the ticket output game machine of FIG. 1 when viewed from below.
Figure 3:
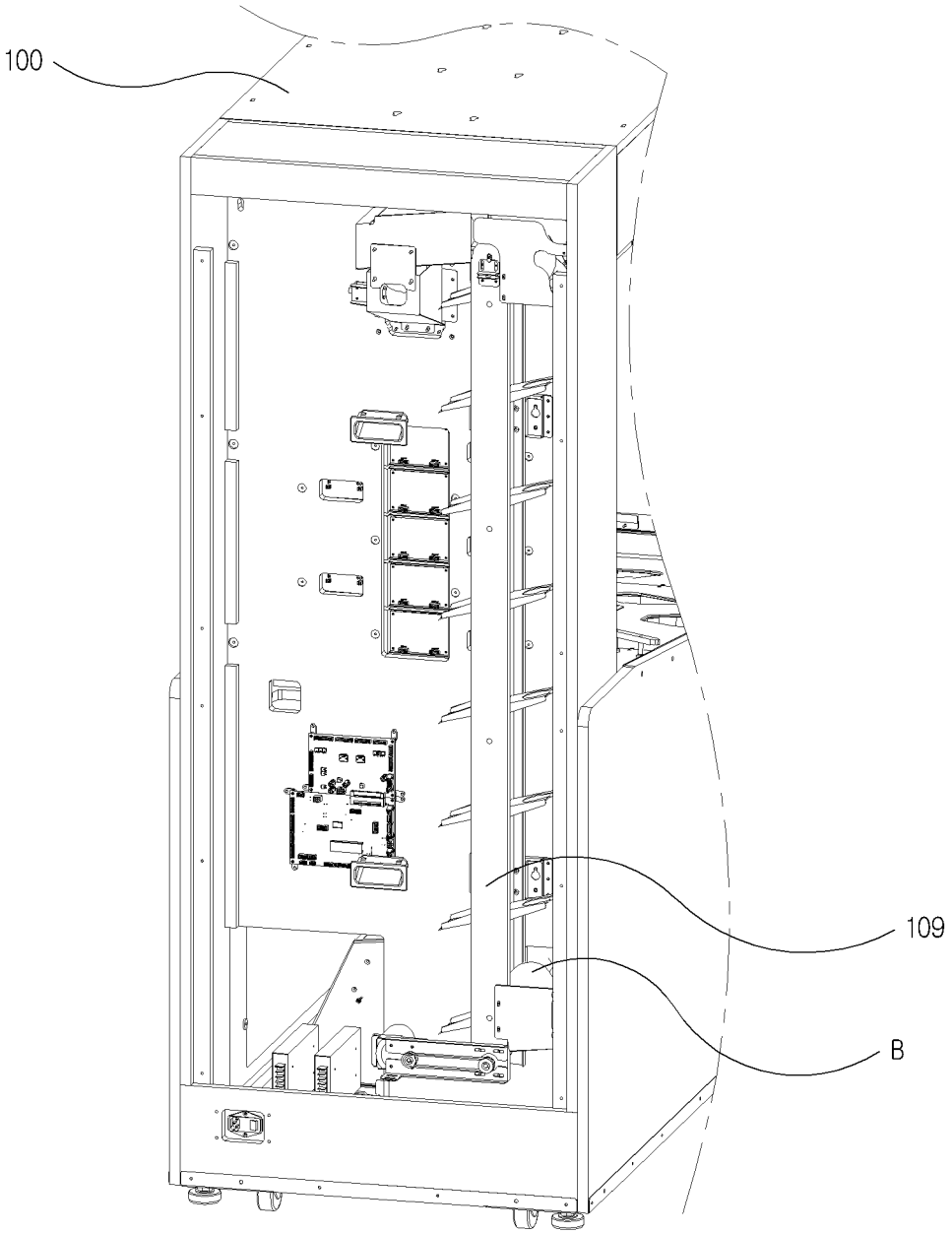
FIG. 3 is a rear perspective view of the ticket output game machine according to the present invention.
Figure 4:
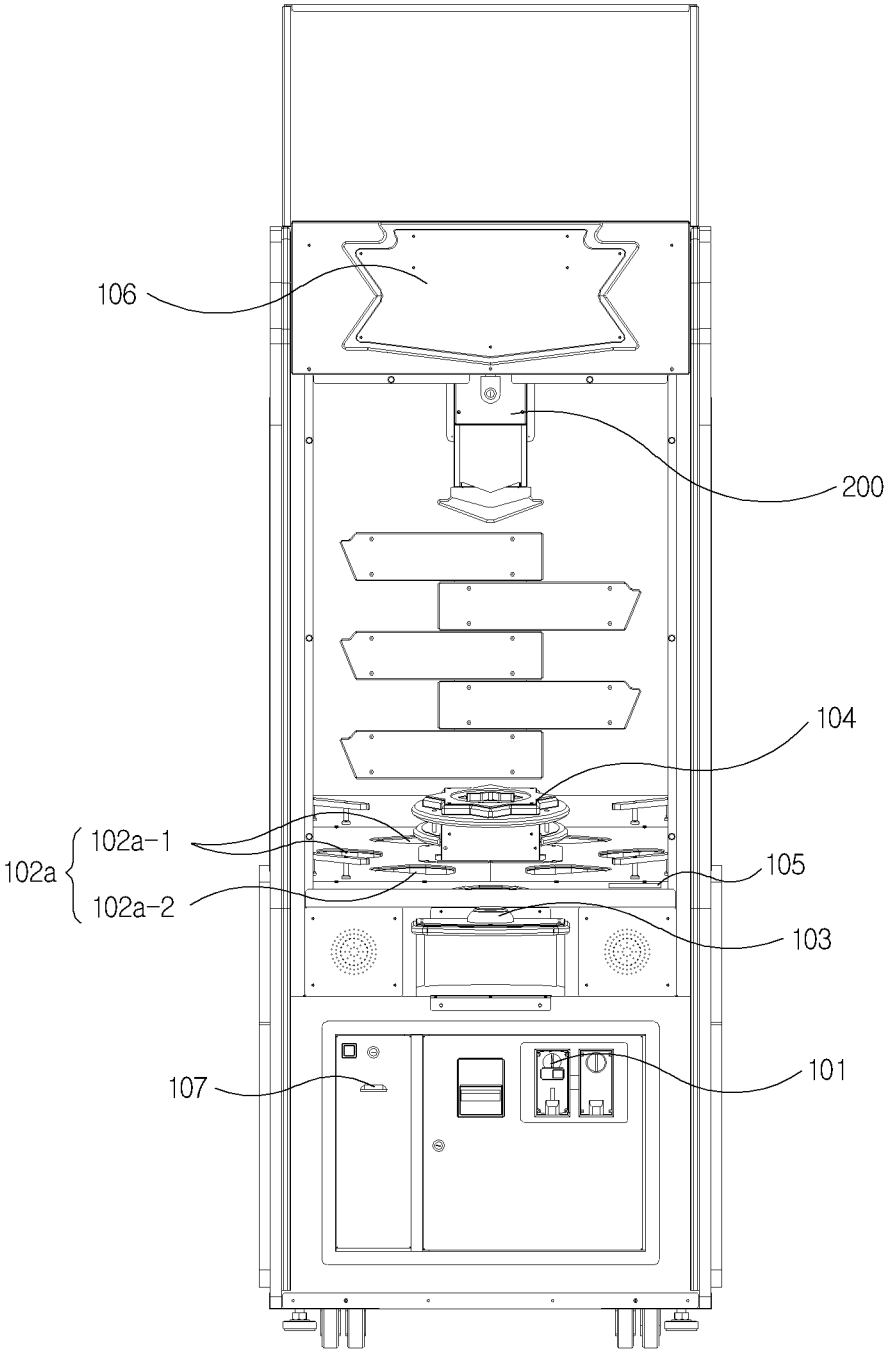
FIG. 4 is a front view of the ticket output game machine according to the present invention.
Figure 5:
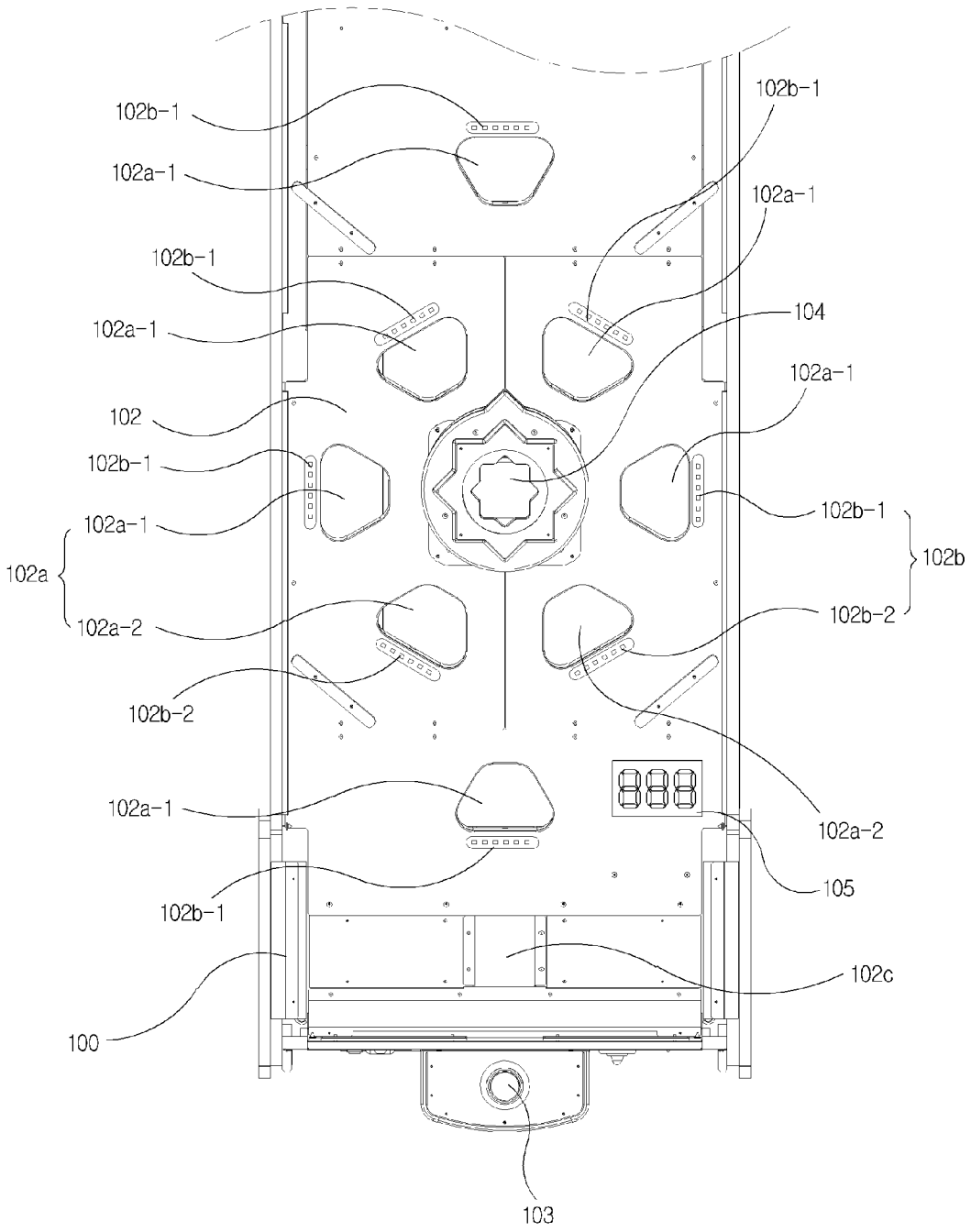
FIG. 5 is a plan view of a game plate of the ticket output game machine according to the present invention.
Figure 6:
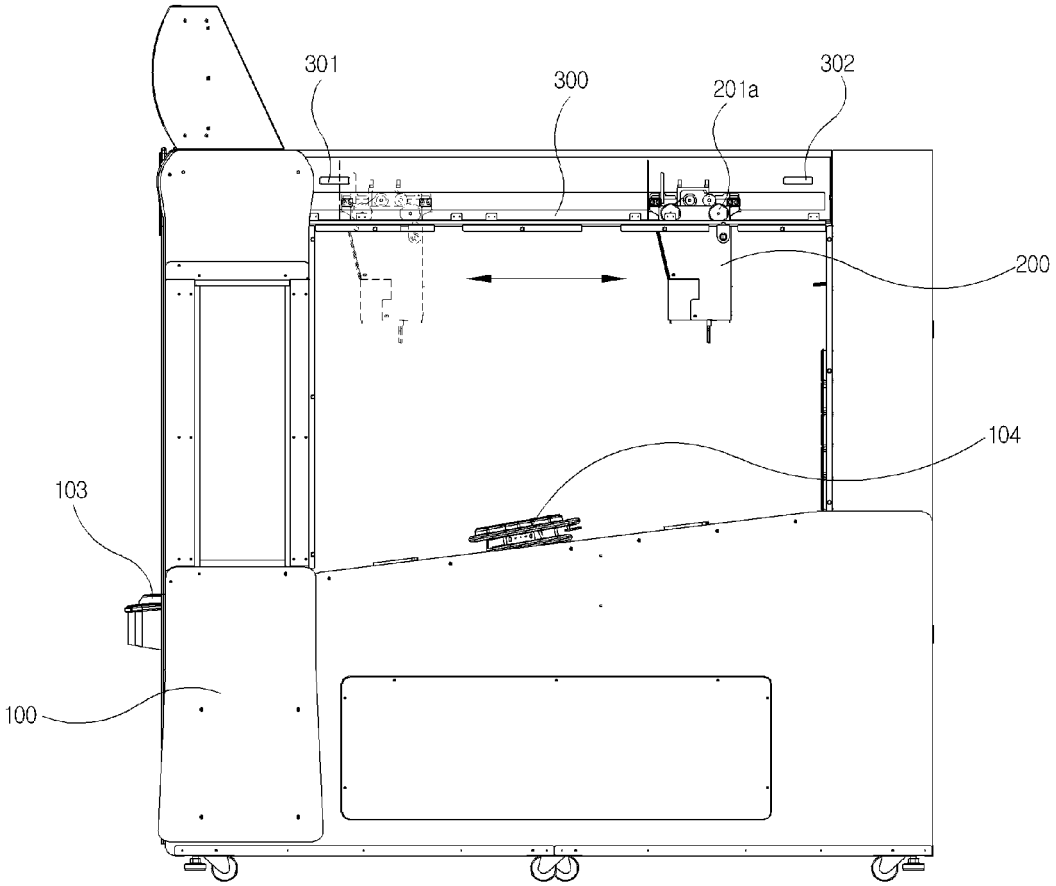
FIG. 6 is a side view illustrating a state in which a ball-throwing portion of the ticket output game machine according to the present invention is moved back and forth.
Figure 7:
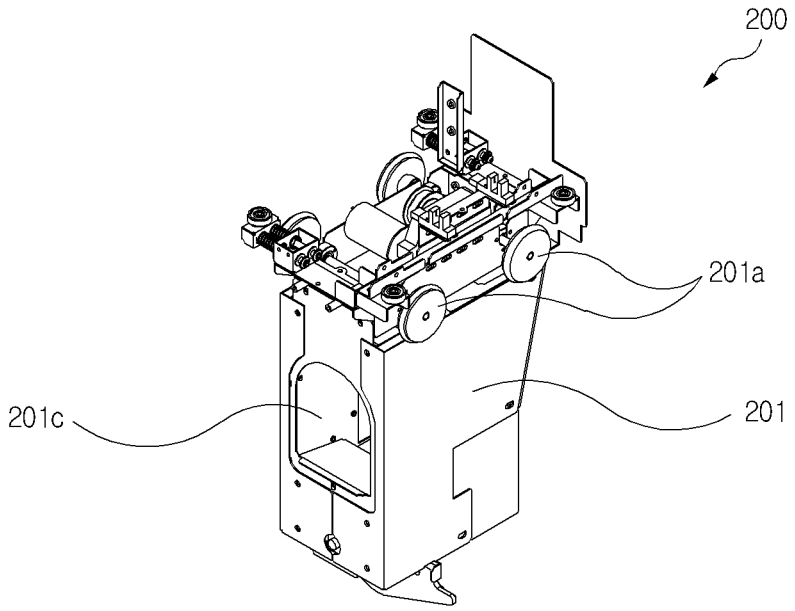
FIG. 7 is a main perspective view of the ball-throwing portion of the ticket output game machine according to the present invention.
Figure 7:
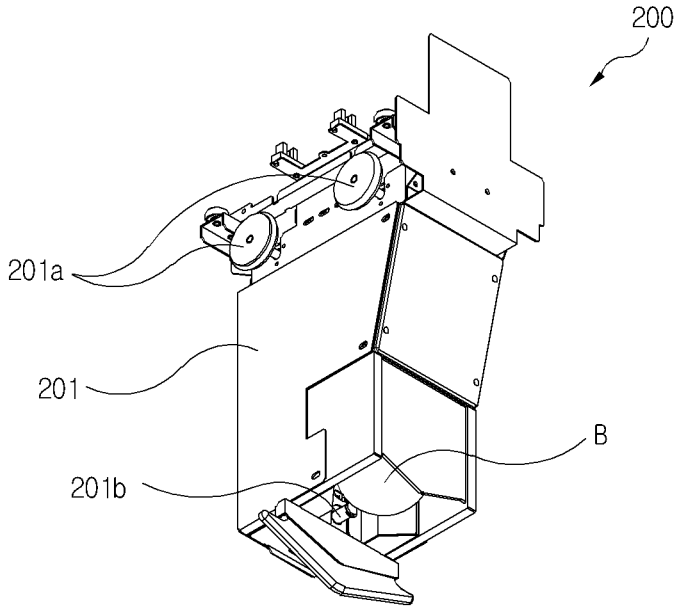
Figure 8:
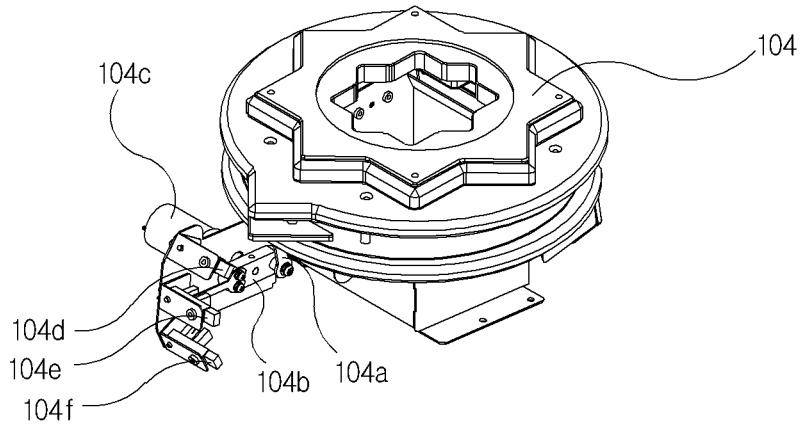
FIG. 8 is a main perspective view illustrating a bonus hole device of the ticket output game machine according to the present invention.
Figure 8:
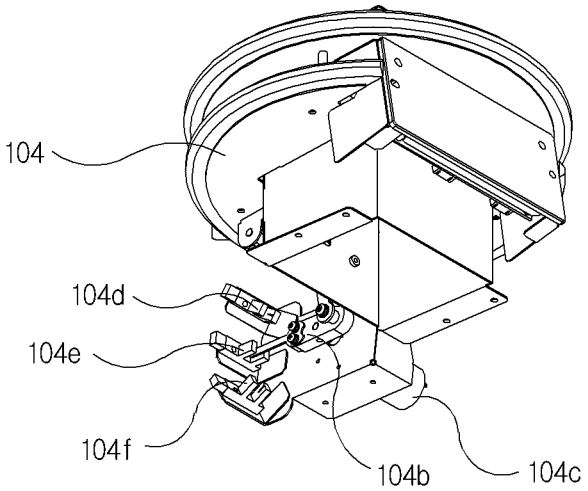
Figure 9:
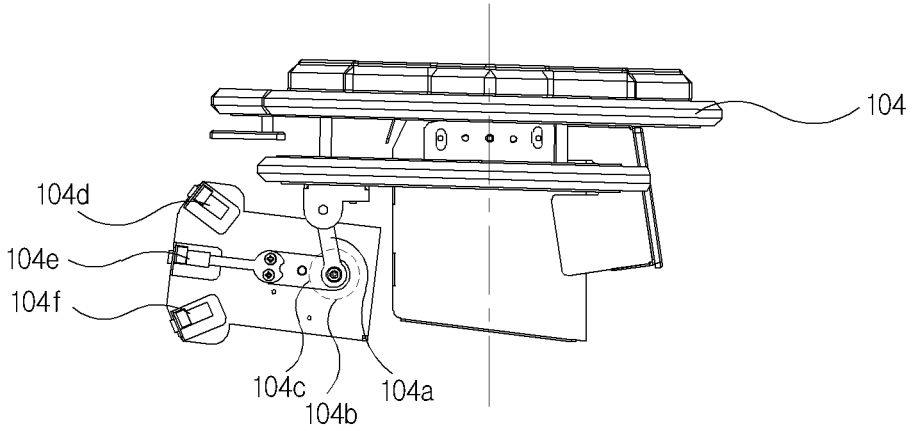
FIG. 9 is a side view illustrating an operation state of the bonus hole device of the ticket output game machine according to the present invention.
Figure 9:
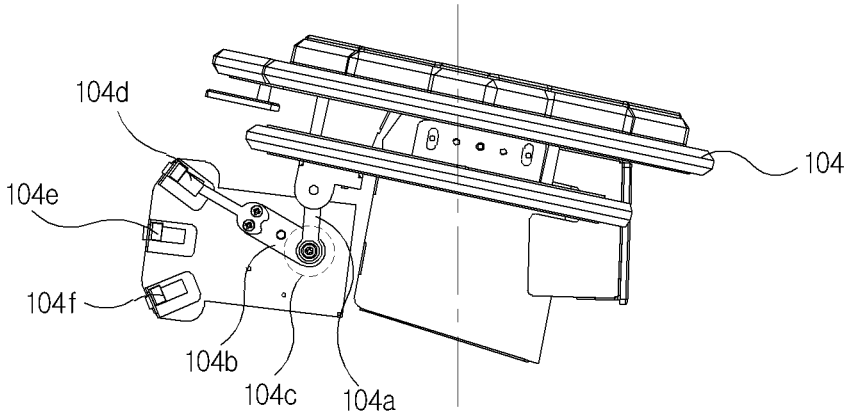

Referring to FIGS. 1 to 9, a body 100 has a hollow shape in which a transparent window 108 for seeing an internal space is formed on a front surface, a game plate 102 formed to be tilted downward and including a ball insertion hole 102*a* and a bonus hole device 104 formed in a top surface thereof is provided on a bottom surface thereinside, light emitting diodes (LEDs) 102*b* configured to emit light are formed on a periphery of the ball insertion hole 102*a*, and a ball discharge hole 102*c* is formed on a bottom end of the game plate 102.

The transparent window 108 is formed of a transparent material to see a state in which a game is performed in the internal space of the body 100.

The game plate 102 is formed to be tilted downward toward the ball discharge hole 102*c* so as to guide a ball B to move toward the ball discharge hole 102*c*.

The game plate 102 includes the bonus hole device 104 in a central part and a plurality of such ball insertion holes 102*a* around an edge of the bonus hole device 104.

The ball insertion hole 102*a* includes a sensor (not shown) formed on an inner edge thereof and configured to sense the ball B which is inserted and to output a signal to a general score plate 105.

The body 100 includes the general score plate 105 formed on one side of a top surface of the game plate 102, connected to the plurality of ball insertion holes 102*a*, and configured to sense the ball B inserted into the ball insertion hole 102*a* and to output a score corresponding to the ball insertion hole 102*a* and a bonus score plate 106 installed on a front surface, connected to the bonus hole device 104, and configured to sense the ball B inserted into the bonus hole device 104 and to output a score corresponding to the bonus hole device 104.

The score of the ball insertion hole 102*a* may be relatively lower than the score of the bonus hole device 104 and may be within a range of one third to one fifth thereof.

The ball insertion hole 102*a* includes a fixed score insertion hole 102*a*-1 configured to sense insertion of the ball B and to output a fixed score to the general score plate 105 and a random score insertion hole 102*a*-2 configured to sense an insertion time of the ball B and to output a score changed at the insertion time of the ball B to the general score plate 105.

The fixed score insertion hole 102*a*-1 is connected to a first LED 102*b*-1 installed on a periphery thereof so that a score thereof is determined according to color of the first LED 102*b*-1 emitting light in fixed color.

The fixed score insertion hole 102*a*-1 outputs different fixed scores to the general score plate 105.

The ball B inserted into the fixed score insertion hole 102*a*-1 is sensed by the sensor, and the sensor outputs a score corresponding to the first LED 102*b*-1 to the general score plate 105.

The random score insertion hole 102*a*-2 is connected to a second LED 102*b*-2 installed on a periphery thereof so that a score thereof is determined according to color of the first LED 102*b*-2 emitting light in a changed color.

The random score insertion hole 102*a*-2 outputs different scores to the general score plate 105 according to color of light emitted by the second LED 102*b*-2.

The score of the random score insertion hole 102*a*-2 may vary at time intervals to correspond to a color change time of the second LED 102*b*-2.

The LED 102*b* includes the first LED 102*b*-1 installed on a periphery of the fixed score insertion hole 102*a*-1 to emit light in different fixed colors and the second LED 102*b*-2 installed on a periphery of the random score insertion hole 102*a*-2 to sequentially emit light in colors corresponding to the plurality of first LEDs 102*b*-1.

The second LEDs 102*b*-2 change color at time intervals. Here, the color may be sequentially changed into a plurality of colors corresponding to the plurality of first LEDs 120*b*-1.

The color of the second LEDs 102*b*-2 sequentially varies at time intervals to correspond to the random score insertion hole 102*a*-2 having a score changed at time intervals.

The ball B inserted into the random score insertion hole 102*a*-2 is sensed by the sensor, and the sensor outputs a score corresponding to the color of the second LED 102*b*-2 to the general score plate 105.

The body 100 includes a coin slot 101 formed in a front surface thereof and into which a coin is inserted.

The body 100 includes a drop button 103 formed in the front surface thereof and connected to the ball throwing portion 200 to allow the ball B to be dropped from the ball throwing portion 200.

The drop button 103 transmits a signal to the ball throwing portion 200 to stop a driving wheel 201*a* of the ball throwing portion 200 as well as releasing a support bar 201*b* supporting the ball B so that the ball B is dropped in a housing 201 of the ball throwing portion 200 or to release the support bar 201*b* while the ball throwing portion 200 is moved on a rail portion 300 so that the ball B is dropped in the housing 201 of the ball throwing portion 200.

The body 100 includes a ticket output portion 107 formed on one side of the coin slot 101 and configured to output a ticket number corresponding to a game score calculated by the ball being inserted into the ball insertion hole 102*a*, the bonus hole device 104, or the ball discharge hole 102*c*.

The ticket output portion 107 calculates a sum of numbers of output tickets when the tickets are output more than a determined number of times and controls an angle of the bonus hole device 104 to be adjusted when the sum of numbers of output tickets exceeds a determined number of output times.

The ticket output portion 107 restricts a game progress of inserting a coin into the coin slot 101 and dropping the ball B onto the game plate 102 using the ball throwing portion 200 to one time. Here, when exceeding a number of times (for example, ten output times) determined by a user, numbers of output tickets are added. When a number of output tickets exceeds a determined ticket number, an angle of the bonus hole device 104 is adjusted by operating a motor 104*c* of the bonus hole device 104.

The body 100 includes a ball supply hole 100*a* formed in an inner wall surface thereof and configured to supply the ball B to the ball throwing portion 200 which has moved backward.

The ball supply hole 100*a* supplies the ball B to the ball throwing portion 200 when the ball throwing portion 200 which drops the ball B onto the game plate 102 is moved backward behind the rail portion 300.

The body 100 further includes an upright transfer rail 109 installed in a rear interior to be upright and configured to move the ball B upward and supply the ball B to the ball supply hole 100*a*.

The upright transfer rail 109 supports and lifts the ball B inserted into the ball discharge hole 102*c* of the game plate 102 and then moved to the upright transfer rail 109.

The ball throwing portion 200 is installed on an inner top end of the body 100 and accommodates the ball B therein and is horizontally moved back and forth to drop the ball B accommodated therein onto the game plate 102 to be inserted into the bonus hole device 104 or the ball insertion hole 102*a* of the body 100.

The ball throwing portion 200 is repetitively moved back and forth along the rail portion 300 above the game plate 102.

The ball throwing portion 200 receives a signal of a front sensor 301 and moves backward behind the rail portion 300 when reaching a front end of the rail portion 300 and receives a signal of a rear sensor 302 and moves forward in front of the rail portion 300 when reaching a rear end of the rail portion 300.

The ball throwing portion 200 drops the ball B onto the game plate 102 of the body 100 and then is moved to be located at the rear end of the rail portion 300 to receive the ball B from the ball supply hole 100*a* of the body 100.

The ball throwing portion 200 includes the housing 201 having a hollow shape with an open bottom, formed on one surface thereof and including a through hole 201*c* communicating with the ball supply hole 100*a*, the driving wheel 201*a* rotatably installed on a top end of the housing 201 and moved along the rail portion 300 to move the housing 201 back and forth, and the support bar 201*b* installed in the housing 201 to be horizontally movable to support the ball B supplied to the inside of the housing 201.

The housing 201 receives and accommodates the ball B therein.

The housing 201 is moved, by the driving wheel 201*a*, to a determined position on the game plate 102.

The driving wheel 201*a* is operated when a coin is inserted into the coin slot 101 and receives a signal of the drop button 103 to be stopped or continuously operated so as to move the housing 201 back and forth.

The driving wheel 201*a* is stopped or continuously operated by manipulating the drop button 103 according to a setting value of the user.

The driving wheel 201*a* may be connected to a driving motor (without reference numeral) installed on a top surface of the housing 201 and may be rotationally operated by the driving motor.

The support bar 201*b* supports the ball B accommodated in the housing 201 and is slidably moved by the drop button 103 to be released so that the ball B is dropped onto the game plate 102.

The support bar 201*b* may be horizontally operated by a solenoid valve.

The rail portion 300 includes the front and rear sensors 301 and 302 longitudinally installed on the inner top end of the body 100 and configured to guide the ball throwing portion 200 to be slidably moved back and forth, to sense the ball throwing portion 200 at front and rear ends thereof, and to restrict movement of the ball throwing portion 200 more than a determined distance to the front end and rear end.

The rail portion 300 guides horizontal movement of the ball throwing portion 200 so that the ball throwing portion 200 moves back and forth above the game plate 102.

The front sensor 301 recognizes that the ball throwing portion 200 reaches the front end of the rail portion 300, outputs a signal to the ball throwing portion 200, and controls the ball throwing portion 200 to move backward behind the rail portion 300.

The rear sensor 302 recognizes that the ball throwing portion 200 reaches the rear end of the rail portion 300, outputs a signal to the ball throwing portion 200, and controls the ball throwing portion 200 to move forward in front of the rail portion 300.

The rear sensor 302 stops operating when the ball B is thrown by the ball throwing portion 200 so as to allow the ball throwing portion 200 to be located at the rear end of the rail portion 300.

A game method using the ticket output game machine configured as described above according to the present invention will be described as follows.

First, a coin is inserted into the coin slot 101 formed in the front surface of the body 100 to allow the ball B to be inserted into the ball throwing portion 200 so that the ball throwing portion 200 is horizontally moved along the rail portion 300 installed in the body 100 while gripping the ball B (S100).

Here, while being located at the rear end of the rail portion 300, the ball throwing portion 200 presses the housing 201 to the ball supply hole 100*a* of the body 100 to allow the through hole 201*c* of the housing 201 to communicate with the ball supply hole 100*a* and to supply the ball B toward the through hole 201*c* through the ball supply hole 100*a* so that the ball B is accommodated in the housing 201.

Here, the ball supply hole 100*a* passes the ball B moved upward by the upright transfer rail 109 therethrough toward the housing 201 of the ball throwing portion 200.

Also, the ball accommodated in the housing 201 is supported by the support bar 201*b* to maintain a state of being accommodated in the housing 201.

Subsequently, the driving wheel 201*a* installed at the top end of the housing 201 moves the housing 201 back and forth on the rail portion 300 while moving along the rail portion 300 so that the ball B gripped by the ball throwing portion 200 is moved back and forth above the game plate 102.

Subsequently, the plurality of LEDs 102*b* formed on the game plate 102 of the body 100 emit light in different colors on the periphery of the ball insertion hole 102*a* (S200).

Here, among the LEDs 102*b*, the first LEDs 102*b*-1 formed on the periphery of the fixed score insertion hole 102*a*-1 of the ball insertion hole 102*a* emit light in different fixed colors, and the second LEDs 102*b*-2 formed on the periphery of the random score insertion hole 102*a*-2 sequentially emit light in a plurality of colors.

That is, the first LEDs 102*b*-1 are installed on the periphery of the fixed score insertion hole 102*a*-1 to be proportional to the number of fixed score insertion holes 102*a*-1 and emit light of different fixed colors to correspond to the respective fixed score insertion holes 102*a*-1 so as to allow the user to see a score of each of the fixed score insertion holes 102*a* with the naked eye.

Also, the second LEDs 102*b*-2 are installed on the periphery of the random score insertion hole 102*a*-2 to be proportional to the number of the random score insertion holes 102*a*-2 and colors thereof sequentially vary to correspond to the colors of the plurality of first LEDs 102*b*-1 so as to allow the user to see a score according to a time difference of the random score insertion hole 102*a*-2 with the naked eye.

Subsequently, when the ball throwing portion 200 moves along the rail portion 300 and reaches the front end or rear end of the rail portion 300, the ball throwing portion 200 is sensed by the front or rear sensor 301 and 302 installed on the front end or rear end of the rail portion 300. Here, a signal is output to the ball throwing portion 200 so as to move the ball throwing portion 200 backward from the front end of the rail portion 300 or forward from the rear end of the rail portion 300 (S300).

Then, it is possible to prevent the ball throwing portion 200 from being moved more than a determined distance from the front end or rear end of the rail portion 300 and deviating from the front end or rear end of the rail portion 300.

Here, the ball throwing portion 200 is sensed continuously by the front or rear sensor 301 or 302 and repetitively moved toward front or rear end of the rail portion 300.

Also, when the drop button 103 of the body 100 is pushed while the ball throwing portion 200 is moved back and forth on the rail portion 300, a signal for manipulating the drop button 103 is transmitted to the ball throwing portion 200 and the ball B gripped by the ball throwing portion 200 is dropped onto the game plate 102 (S400).

Here, rotation of the driving wheel 201*a* of the ball throwing portion 200 is stopped by pushing the drop button 103 so that the housing 201 of the ball throwing portion 200 is located at a determined position above the game plate 102. Here, the support bar 201*b* slides and releases support of the ball B so that the ball B is dropped onto the game plate 102 through a bottom end of the housing 201.

Here, the ball throwing portion 200 may receive a signal of the drop button 103 according to a setting value of the user, control the driving wheel 201*a* to continuously move along the rail portion 300, and slidably move the support bar 201*b* so that the ball B may be dropped onto the bottom end of the housing 201 while the ball throwing portion 200 moves along the rail portion 300.

Subsequently, when the ball B is dropped in the housing 201, the support bar 201*b* is restored to an original state and the driving wheel 201*a* is rotationally operated so as to move the housing 201 to the rear end of the rail portion 300.

Here, the rear sensor 302 of the rail portion 300 stops operating and allows the ball throwing portion 200 to move backward.

Then, the through hole 201*c* of the housing 201 maintains a state of being located so as to communicate with the ball supply hole 100*a* of the body 100.

Subsequently, a score is displayed on the general score plate 105 or the bonus score plate 106 of the body 100 by analyzing a color signal of the LED 102*b* corresponding to the ball insertion hole 102*a* into which the ball B dropped from the housing 201 is inserted, a signal of the bonus hole device 104, or a signal of the ball discharge hole 102*c* (S500).

That is, when the ball B is inserted into the fixed score insertion hole 102*a*-1 among the ball insertion holes 102*a*, a score corresponding to the fixed score insertion hole 102*a*-1 is output to the general score plate 105 of the body 100.

Here, the first LED 102*b*-1 emitting fixed-color light among the LEDs 102*b* is installed on the periphery of the fixed score insertion hole 102*a*-1 and the score of the fixed score insertion hole 102*a*-1 is determined to correspond to the color of the first LED 102*b*-1 so that a deviation occurs in scores output on the general score plate 105 according to the fixed score insertion hole 102*a*-1 into which the ball B is inserted among the plurality of fixed score insertion holes 102*a*-1.

For example, when the ball B is inserted into the fixed score insertion hole 102*a*-1 corresponding to the first LED 102*b*-1 emitting red light among the first LEDs 102*b*-1, one hundred points are output to the general score plate 105. Also, when the ball B is inserted into the fixed score insertion hole 102*a*-1 corresponding to the first LED 102*b*-1 emitting blue light, fifty points are output to the general score plate 105. Accordingly, a deviation in scores is caused.

Also, when the ball B is inserted into the random score insertion hole 102*a*-2 among the ball insertion holes 102*a*, a score of the random score insertion hole 102*a*-2 which varies when the ball B is inserted into the random score insertion hole 102*a*-2 is output to the general score plate 105.

That is, the score of the random score insertion hole 102*a*-2 continuously varies to allow the second LED 102*b*-2 installed on the periphery of the random score insertion hole 102*a*-2 to correspond to color of emitted light. Here, the score varies according to a time when the ball is inserted into the random score insertion hole 102*a*-2 to correspond to the second LED 102*b*-2 so that a deviation occurs in scores output to the general score plate 105.

For example, when the ball B is inserted into the random score insertion hole 102*a*-2 at a time when the second LED 102*b*-2 emits red light, the random score insertion hole 102*a*-2 outputs one hundred points to the general score plate 105. When the ball B is inserted into the random score insertion hole 102*a*-2 at a time when the second LED 102*b*-2 emits light changed to blue, the random score insertion hole 102*a*-2 outputs fifty points to the general score plate 105. Accordingly, a deviation in scores is caused.

Here, the ball B inserted into the fixed score insertion hole 102*a*-1 or the random score insertion hole 102*a*-2 is sensed by the sensor and a score corresponding to the first LED 102*b*-1 of the fixed score insertion hole 102*a*-1 or the second LED 102*b*-2 of the random score insertion hole 102*a*-2 is output to the general score plate 105.

Meanwhile, when the ball B dropped from the ball throwing portion 200 is inserted into the bonus hole device 104, the bonus hole device 104 outputs a score to the bonus score plate 106 so that a bonus score is seen through the bonus score plate 106.

Also, when the ball B is dropped onto the game plate 102, the ball B is guided to the game plate 102, moved toward the ball discharge hole 102*c*, and discharged to the game plate 102 through the ball discharge hole 102*c* so that a score relatively lower than a score of being inserted into the ball insertion hole 102*a* is output to the general score plate 105.

Here, a score output to the general score plate 105 when the ball is inserted into the bonus hole device 104 may be formed to be relatively higher, by three to five times, than a greatest score of the plurality of ball insertion holes 102*a*. A score output to the general score plate 105 when the ball is inserted into the ball discharge hole 102*c* may be formed to be relatively lower than a lowest score of the plurality of ball insertion holes 102*a*.

Subsequently, a number of tickets corresponding to a score output to the general score plate 105 or the bonus score plate 106 is calculated and tickets are output through the ticket output portion 107 formed in the body 100 (S600).

Here, a time when a game is performed by inserting a coin through the coin slot 101 and tickets are output through the ticket output portion 107 is defined as one time. The numbers of output tickets output through the ticket output portion 107 are added when a number of output tickets exceeds a determined number of times and when the number of output tickets is relatively higher than a determined number of tickets, an angle of the bonus hole device 104 is automatically adjusted.

That is, the number of output tickets from the ticket output portion 107 and the number of tickets are calculated at the same time and the motor 104*c* of the bonus hole device 104 is rotationally driven, and a connection rod 104*a* and a rotational rod 104*b* which are connected to the motor 104*c* are rotated at the same time. Here, the connection rod 104*a* rotates the bonus hole device 104 so as to adjust the angle of the bonus hole device 104.

Here, the angle of the bonus hole device 104 is changed so that the bonus hole device 104 faces the front or rear of the body 100 on the basis of a vertical line at a center thereof.

Also, at the moment that an end of the rotational rod 104*b* reaches a top end sensor 104*d*, an intermediate end sensor 104*e*, or a bottom end sensor 104*f*, any one of the top end sensor 104*d*, the intermediate end sensor 104*e*, or the bottom end sensor 104*f* outputs a signal to the motor 104*c* so that operating of the motor 104*c* is stopped. Accordingly, rotation of the connection rod 104*a* is stopped so that the bonus hole device 104 is fixed at a determined angle.

In the above structure, while the ball throwing portion 200 gripping the ball B is moved along the rail portion 300, the ball B is dropped onto the game plate 102 using the drop button 103 so as to be inserted into the ball insertion hole 102*a* or the bonus hole device 104, and since a game may be performed by simply manipulating the drop button 103 while the ball throwing portion 200 moves along the rail portion 300, it is unnecessary to exhaust physical strength and everyone regardless of age or gender may easily perform a game by manipulating the drop button 103. An insertion probability that the ball B is inserted into the ball insertion hole 102*a* or the bonus hole device 104 is changed by dropping the ball B downward while a movement speed of the ball throwing portion 200 moving along the rail portion 300 and a ball drop position are analyzed. Due to a change in the insertion probability of the ball B according to the above strategy, interest in playing the game is generated and at the same time, a strategy is required. Also, when the ball is inserted into the bonus hole device 104 or the plurality of ball insertion holes 102 corresponding to the LEDs 102*b* emitting different-color light, different scores are obtained so as to generate interest in the game.

According to the present invention, since it is possible to perform a game by simply manipulating a drop button while a ball throwing portion moves along a rail portion, exhaustion of physical strength is unnecessary. Also, since the game is performed by manipulating the drop button, everyone regardless of age or gender may easily perform the game. The ball is dropped downward while a movement speed of the ball throwing portion moving along the rail portion and a drop position of the ball are analyzed so that an insertion probability that the ball is inserted into a ball insertion hole or a bonus hole device varies. Due to a change of insertion probability of the ball according to the above strategy, interest is generated in playing the game, and at the same time, a strategy is required. Also, when the ball is inserted into the bonus hole device or a plurality of such ball insertion holes corresponding to LEDs emitting light having different colors, different scores are obtained so as to cause interest in the game. Particularly, at a moment that the ball is inserted into the ball insertion hole or the bonus hole device, a pleasant feeling as well as fun of the game increase so that reliability of a product increases.

The above-described game method using the ticket output game machine according to the present invention is not limited to the embodiment, and the technical concept thereof is present within the range of being implemented by any one of ordinary skill in the art without departing from the essential of the present invention disclosed in the following claims.

What is claimed is:

1. A game method using a ticket output game machine, comprising:

a first process (S100) of inserting a coin into a coin slot (101) formed in a front surface of a body (100) to allow a ball (B) to be inserted into a ball throwing portion (200) and horizontally moving the ball throwing portion (200) along a rail portion (300) installed on an inner top end of the body (100) while gripping the ball (B);

a second process (S200) of allowing a plurality of light emitting diodes (LEDs) (102*b*) installed on a game plate (102) to correspond to a plurality or ball insertion holes (102*a*) to emit light having different colors, the game plate (102) being installed right below the rail portion (300) and comprising a plurality of ball insertion holes (102*a*) on a top surface thereof;

a third process (S300) of sensing the ball throwing portion (200) moving along the rail portion (300) using a front sensor (301) and moving the ball throwing portion (200) backward when the ball throwing portion (200) reaches a front end of the rail portion (300) and sensing the ball throwing portion (200) using a rear sensor (302) and moving the ball throwing portion (200) frontward when the ball throwing portion (200) reaches a rear end of the rail portion (300);

a fourth process (S400) of pushing a drop button (103) formed on the front surface of the body (100) to allow the ball (B) gripped by the ball throwing portion (200) to be dropped onto the game plate (102);

a fifth process (S500) of analyzing a color signal or the LED (102*b*) corresponding to the ball insertion hole (102*a*) into which the ball (B) dropped in the fourth process (S400) is inserted and displaying a score based on the analyzed color signal on a general score plate (105) formed on one side of a top surface of the game plate (102), wherein the score is a first score when the color signal is a first color signal and the score is a second score when the color signal is a second color signal, the first score being different than the second score; and a sixth process (S600) of calculating a number of tickets corresponding to the score displayed in the fifth process (S500) and outputting the tickets through a ticket output portion (107) formed on the front surface of the both (100).

2. The method of claim 1, wherein in the first process (S100), the ball throwing portion (200) is moved along the rail portion (300) to be located at a ball supply hole (100*a*) formed in an inner rear surface of the body (100), receives the ball (B) discharged through the ball supply hole (100*a*) and keeps the ball (B) in a housing (201) of the ball throwing portion (200) and stands by, and when the coin is inserted into the coin slot (101), controls driving wheels (201*a*) formed on both sides of a top end of the housing (201) to move along a top surface of the rail portion (300).

3. The method of claim 1, wherein in the fourth process (S400), the ball throwing portion (200) releases a support bar (201*b*) located at a determined position on the rail portion (300), horizontally moved in the housing (201), and supporting the ball (B) by receiving a signal of the drop button (103) and stopping rotation of driving wheels (201*a*) formed on both sides of the top end of the housing (201) of the ball throwing portion (200) so as to control the ball (B) to be dropped onto the game plate (102).

4. The method of claim 1, wherein in the fourth process (S400), the ball throwing portion (200) receives a signal of the drop button (103) and releases a support bar (201*b*) horizontally moved in the housing (201) and supporting the ball (B) while being continuously moved along the rail portion (300) by driving wheels (201*a*) so as to control the ball (B) to be dropped onto the game plate (102).

5. The method of claim 1, wherein in the fifth process (S500), a plurality of such ball insertion holes (102*a*) are formed on a periphery of an edge of a bonus hole device (104) and comprise first LEDs (102*b*-1) emitting light having different colors and fixed score insertion holes (102*a*-1) corresponding to the first LEDs (102*b*-1), wherein a plurality of such ball insertion holes (102*a*) are Formed on a periphery an edge of the bonus hole device (104) and comprise second LEDs (102*b*-2) having a plurality of colors sequentially changed corresponding to a color of the plurality of first LEDs (102*b*-1) and random score insertion holes (102*a*-2) corresponding to the second LEDs (102*b*-2), and wherein the bonus hole device (104) is formed in a central part of the game plate (102) and allows the ball (B) to be inserted thereinto so as to display a score on the bonus score plate (106).

6. The method of claim 1, wherein in the sixth process (S600), a sum of numbers of output tickets is obtained when a number of times of outputting tickets through the ticket output portion (107) exceeds a determined number of times, and an angle of a bonus hole device (104) is adjusted when the number of tickets exceeds a determined output number.

7. The method of claim 6, wherein in the sixth process (S600), the angle of the bonus hole device (104) is adjusted by rotating a connection rod (104*a*) rotatably installed at a bottom end of the bonus hole device (104) and a connection shaft of a rotational rod (104*b*) rotatably installed on the connection rod (104*a*) at the same time, and a tilted angle of the bonus hole device (104) is adjusted by allowing an end of the rotational rod (104*e*) rotated by the motor (104*c*) to be stopped at any one of a top end sensor (104*d*), an intermediate end sensor (104*e*), and a bottom end sensor (104*f*) which are installed below the bonus hole device (104).

* * * * *